US011231156B1

(12) United States Patent
Palmer, III

(10) Patent No.: US 11,231,156 B1
(45) Date of Patent: Jan. 25, 2022

(54) WEATHERPROOF SOLAR PUMPKIN/CUCURBIT ILLUMINATOR

(71) Applicant: Robert William Palmer, III, China, ME (US)

(72) Inventor: Robert William Palmer, III, China, ME (US)

( * ) Notice: Subject to any disclaimer, the term of this patent is extended or adjusted under 35 U.S.C. 154(b) by 0 days.

(21) Appl. No.: 16/793,621

(22) Filed: Feb. 18, 2020

(51) Int. Cl.

| | |
|---|---|
| ***F21S 9/03*** | (2006.01) |
| ***F21V 31/00*** | (2006.01) |
| ***F21V 33/00*** | (2006.01) |
| ***F21Y 115/10*** | (2016.01) |
| ***F21W 121/00*** | (2006.01) |
| ***F21V 3/04*** | (2018.01) |
| ***F21V 3/06*** | (2018.01) |
| ***F21V 21/08*** | (2006.01) |

(52) U.S. Cl.
CPC ..... *F21S 9/037* (2013.01); *F21V 21/08* (2013.01); *F21V 31/005* (2013.01); *F21V 33/0028* (2013.01); *F21V 3/04* (2013.01); *F21V 3/06* (2018.02); *F21W 2121/00* (2013.01); *F21Y 2115/10* (2016.08)

(58) Field of Classification Search
CPC ..... F21S 9/037; F21V 21/0824; F21V 3/04; F21V 3/06; F21V 33/0028; F21V 21/08
See application file for complete search history.

(56) References Cited

U.S. PATENT DOCUMENTS

| | | | | |
|---|---|---|---|---|
| 5,091,833 A * | 2/1992 | Paniaguas | A63H 3/365 | 362/191 |
| 6,402,338 B1 * | 6/2002 | Mitzel | F21V 23/0442 | 362/154 |
| 7,188,976 B1 * | 3/2007 | Fung | F21V 17/04 | 362/351 |
| 7,237,922 B2 * | 7/2007 | Cayton | A63H 33/22 | 362/186 |
| 8,220,964 B1 * | 7/2012 | Martin | F21V 33/0028 | 362/249.16 |

(Continued)

OTHER PUBLICATIONS

"Pumpkin Light Product Offerings", Internal research on cucurbit lighting products, Solar Fright, Inc., 1 page [retrieved on or before Feb. 18, 2020]. Retrieved from the Internet: <url:http://www.amazon.com/Pumpkin-LED-Candle-Light-Colors/dp/B005OMUZ1S>and <url:http://www.fleetfarm.com/detail/Sylvania-LED-Pumpkin-Light>, 1 page.

*Primary Examiner* — Alan B Cariaso
(74) *Attorney, Agent, or Firm* — Leber IP Law; David C. Robertson

(57) ABSTRACT

A weatherproof solar illuminator and method for use with a carved cucurbit having an external housing with integral cucurbit flesh auger, power source, solar-activated charging panel, light emitting diode (LED) and clear lens at the end of the flesh auger to illuminate the cucurbit. The weatherproof solar illuminator is inserted and screwed down flush to the exterior surface of the cucurbit. The illuminating end of the weatherproof solar illuminator protrudes into the cavity of the carved cucurbit to illuminate the inside of the cucurbit. The flesh auger holds the weatherproof solar illuminator secure and flush to the exterior surface of the cucurbit. A concaved/curved bottom of the housing weatherproofs the opening of the cucurbit into which the apparatus is inserted.

14 Claims, 3 Drawing Sheets

(56) References Cited

U.S. PATENT DOCUMENTS

| | | | | |
|---|---|---|---|---|
| 8,496,346 | B2 * | 7/2013 | Zinox | F21S 9/037 362/183 |
| 8,721,133 | B2 * | 5/2014 | Muccianti | F21S 6/001 362/368 |
| 9,328,914 | B2 * | 5/2016 | Ksobiech | F21V 33/008 |
| 2003/0210555 | A1 * | 11/2003 | Cicero | B44C 5/005 362/555 |
| 2012/0134143 | A1 * | 5/2012 | Lederer | F21S 9/037 362/183 |
| 2017/0276303 | A1 * | 9/2017 | Chen | F21V 23/0414 |

* cited by examiner

PLAN VIEW

CROSS SECTION A-A

WEATHERPROOF SOLAR PUMPKIN/CUCURBIT ILLUMINATOR

FIELD OF INVENTION

The present application relates to the field of illumination, and in particular, to an illuminator which uses a carved cucurbit housing to encase the light source.

BACKGROUND

Approximately $1.6 billion of revenue is earned from pumpkin sales each year, most of which is spent on pumpkins for ornamental use. Pumpkins have a hard, rounded shell, which enables them to be easily carved. Traditionally, pumpkins are carved and illuminated, but other gourds and shelled fruits, such as watermelons, gourds, squash, etc. (known as "cucurbits") are also susceptible for carving, illumination and ornamental use.

Pumpkins are traditionally illuminated with candles or other lighting. Candles, particularly tea lights, are one of the most common ways to light a cucurbits and jack-o'-lanterns. Candles present a fire hazard, and need to be replaced frequently. Candles are often also a weaker light source and may be extinguished by wind or rain.

There have been numerous attempts in the prior art to design an alternative light system for illuminating cucurbits and jack-o'-lanterns. One example is taught by U.S. patent application Ser. No. 12/768,539. What is needed is an improved apparatus for overcoming the limitations of the traditional and prior art methods of illumination.

SUMMARY OF THE INVENTION

The present design is an illuminating apparatus comprised of a housing forming a concaved/curved surface plate having an upper surface and a lower surface, flesh auger to secure the illuminator to the cucurbit and a LED and clear lens for the light source. In various embodiments, additional components, such as, on/off switches, multiple lighting components, multiple colored lens components, lighting effects such as "flickering" or "strobing", multi-colored LEDs, audio components, motion sensing/detection, voice actions, wireless remote-control technology, and other components may be included.

In one aspect, there is a weatherproof solar illuminator for use with a carved cucurbit having a top and bottom, external housing with a cucurbit flesh auger, power source, solar-activated charging panel and light emitting diode (LED) and clear lens at the end of the flesh auger to illuminate the cucurbit. A ½" diameter hole is made in the top of the cucurbit to insert the weatherproof solar illuminator. The weatherproof solar illuminator is screwed down flush to the exterior surface of the cucurbit. The flesh auger holds the weatherproof solar illuminator secure and flush to the exterior surface of the cucurbit. The concaved/curved bottom of the housing will also weatherproof the hole placed into the cucurbit. The illuminating end of weatherproof solar illuminator will protrude into the cavity of the carved cucurbit to illuminate the inside of the cucurbit.

In another aspect, there is a weatherproof solar illuminator for use with a carved cucurbit having a top and a bottom, comprised of: a upper formed housing and a lower concaved/curved surface plate, flesh auger and LED with clear lens; said flesh auger further being secured and positioned for insertion down-through a hole in said top/side of said carved cucurbit; said lower surface rests on the outer surface of the cucurbit; a LED being secured to said flesh auger, said flesh auger and LED being positioned perpendicular to outer surface of the cucurbit, the power source component being electrically coupled to the LED; and said flesh auger to secure said weatherproof solar illuminator to outer surface of carved cucurbit.

In yet another aspect, there is an apparatus for use with a carved cucurbit having a top and a bottom, the apparatus comprising: a housing to support the power source, flesh auger, LED, and clear lens, wherein the auger is attached to the housing, and further wherein the illuminator is disposed to be received down-through a hole in the top of the carved cucurbit.

In the aspects above and other aspects herein described, the apparatus may comprise a flesh auger to secure the illuminator to a carved cucurbit. In some embodiments, the apparatus may further comprise pimpled finger indent(s) for gripping weatherproof solar illuminator housing while installing and augering flesh auger securely to the surface of the carved cucurbit. The apparatus may comprise a weatherproof housing and weatherproof gasket and or pre-molded gasket to the upper housing unit and to the bottom of the housing unit.

In still other embodiments, the apparatus may further comprise at least one rechargeable power source, the power source being recharged by solar energy. The apparatus may further comprise a power source component electrically coupled to the LED. The power source component may be a rechargeable dry-cell battery, although the apparatus' power supply is not limited solely to rechargeable batteries. Other embodiments may employ power sources, such as rechargeable batteries, disposable dry cell batteries, direct current and alternating current power, wherein the housing and power source component is disposed to provide power to the illuminator through the hole in the said top of the said carved cucurbit.

As further described, there is a method of employing the herein described weatherproof solar illuminator to illuminate a natural carved cucurbit, a manmade carved cucurbit, or a to illuminate other materials, natural or manmade using the apparatus as described.

BRIEF DESCRIPTION OF THE DRAWINGS

Embodiments of the present invention will now be described, by way of example only, with reference to the attached Figures.

DETAILED DESCRIPTION OF THE INVENTION

Figure 1:
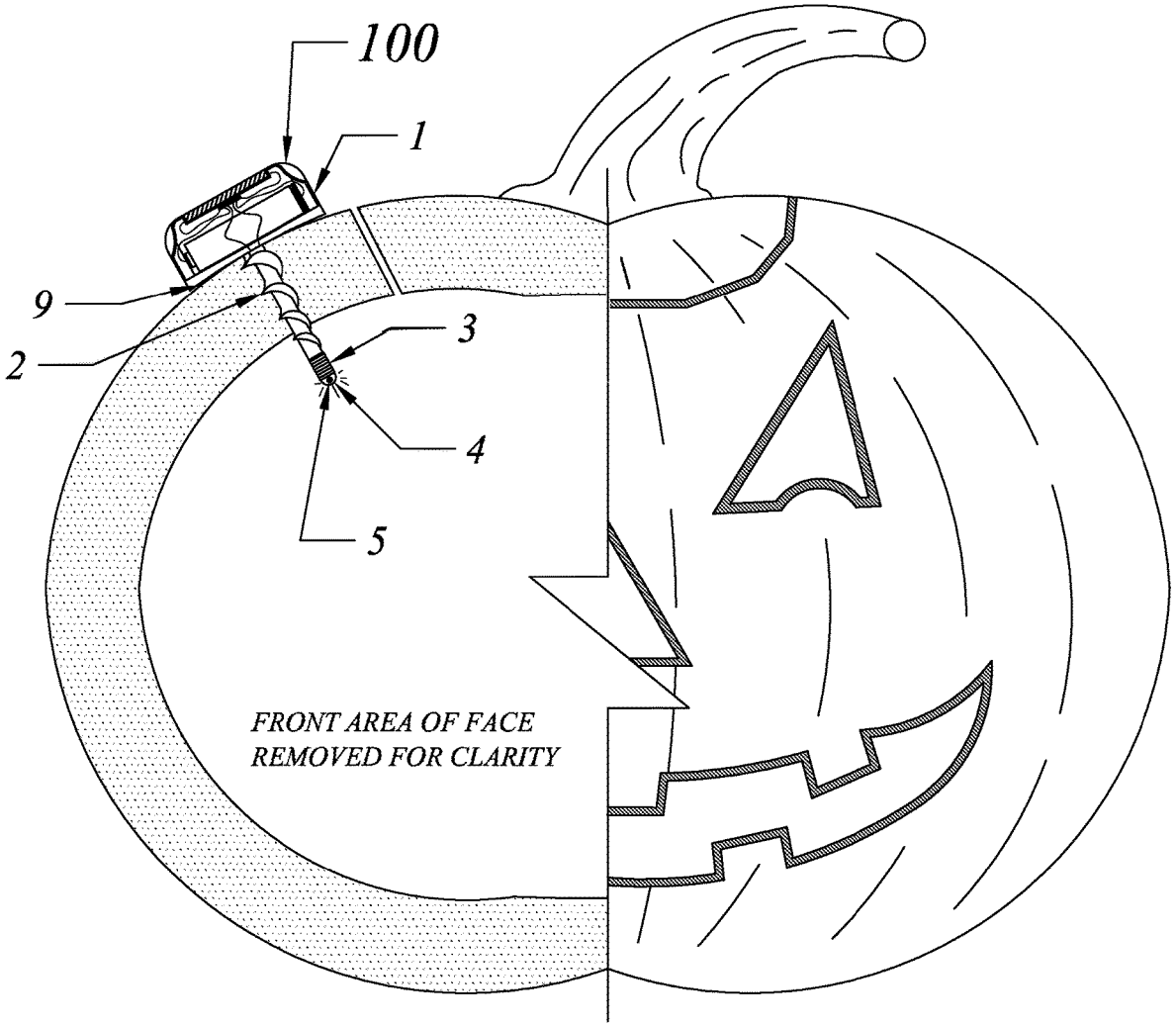
FIG. 1 illustrates the front elevation with cross section of a carved and hollowed-out pumpkin with the cucurbit weatherproof solar illuminator installed.

For the purpose of promoting an understanding of the present design, references are made in the text to exemplary embodiments of a cucurbit-illuminating device, only some of which are described herein. It should be understood that no limitations on the scope of the design are intended by describing these exemplary embodiments. One of ordinary skill in the design will readily appreciate that alternate but functionally equivalent components, materials and configurations may be used. The inclusion of additional elements may be deemed readily apparent and obvious to one of ordinary skill in the design. Specific elements disclosed herein are not to be interpreted as limiting, but rather as a basis for the claims and as a representative basis for teaching one of ordinary skill in the design to employ the present design. It should be understood that the drawings are not necessarily to scale; instead, emphasis has been placed upon illustrating the principles of the design. In addition, in the embodiments depicted herein, like reference numerals in the various drawings refer to identical or near identical structural elements. Moreover, the terms "substantially" or "approximately" as used herein may be applied to modify any quantitative representation that could permissibly vary without resulting in a change in the basic function to which it is related.

As used herein, the term "cucurbit" refers to various plants of the family Cucurbitaceae, which includes the squash, pumpkin, cucumber, gourd, watermelon and cantaloupe. As used herein, a cucurbit shall also include synthetic cucurbits.

As used herein, the term "LED" refers to light emitting diode.

As used herein, the term "power source" refers to electrical sources, a battery and/or a solar energy storage device and/or other direct current or alternating current power sources.

As used herein, the term "integrally constructed" means molded units or fixedly attached.

As used herein, the term "selectively attachable" means removable for use. A selectively attachable component may be tethered, concaved/curved for attachment, or fastened or mounted in an unsecured manner.

As used here, the term "illuminator" refers to a portable device that generates light and has a casing for enclosing a light source.

As used herein, the term "casing" means a component that encases a light source and/or other electrical components.

FIG. 1 illustrates a cross section and elevation view of one exemplary embodiment of the cucurbit weatherproof solar illuminator 100 installed in a hollowed-out jack-o'-lantern. As illustrated in FIG. 1, cucurbit illuminator 100 is comprised of support housing 1, flesh auger 2, flexible neck 3, translucent lens 4, LED 5, and concaved/curved base plate 9. In various embodiments, additional components, such as multiple lighting components, multiple colored lens components, lighting effects such as "flickering" or "strobing", audio components, motion sensing/detection, voice activation, wireless remote-controlled technology, and other components may be included.

Figure 2:
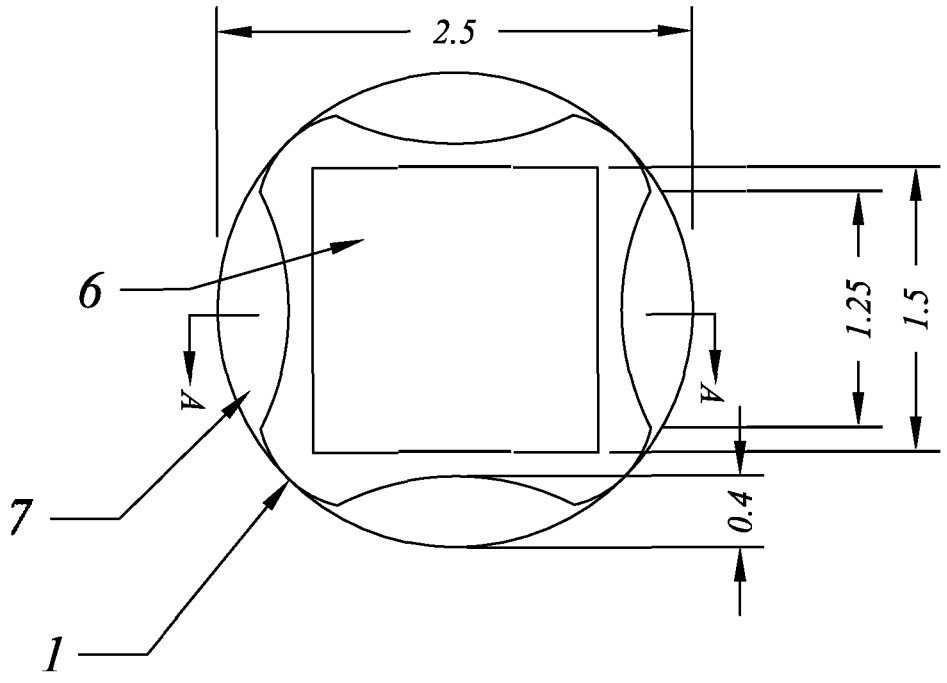
FIG. 2 illustrates the top view of the cucurbit weatherproof solar illuminator.

FIG. 2 illustrates a top view of a cucurbit weatherproof solar illuminating device 100 with support housing 1, solar panel 6, and finger indent(s) 7. The diameter of support housing 1 is approximately 2.5 inches with four approximately 0.4 inch by approximately 1.25 inch pimpled finger indents 7, equally spaced around the support housing 1. The solar panel 6 is approximately 1.5 inches square.

Figure 3:
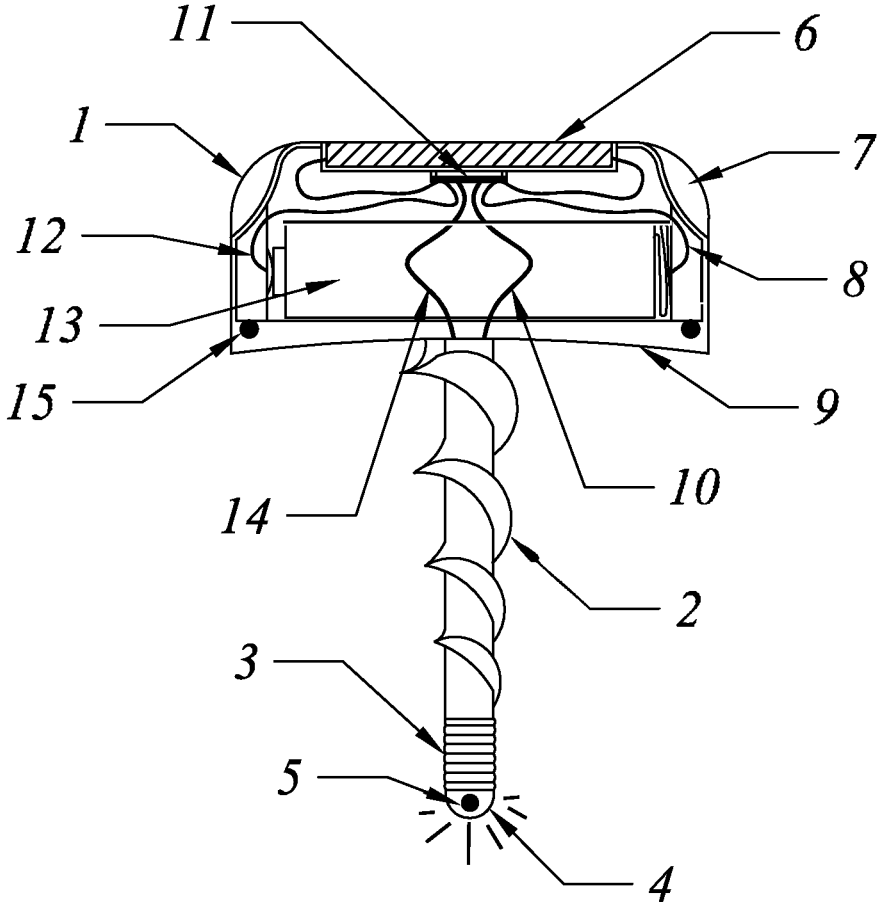
FIG. 3 illustrates a cross section of the cucurbit weatherproof solar illuminator.

FIG. 3 illustrates a cross sectional view of a cucurbit weatherproof solar illuminator 100. In the embodiment shown, support housing 1 is integrally constructed to flesh auger 2. Support housing 1 incorporates solar panel 6, resistor sensor 11, power source 13, solar positive wiring 12, solar negative wiring 8, LED positive wiring 14, LED negative wiring 10, concaved/curved bottom 9, and pimpled finger indents 7, flexible neck 3, translucent lens 4, and LED 5. Flesh auger 2 attaches to flexible neck 3. Flexible neck 3 attaches to flesh auger 2, LED 5, and threads to connect translucent lens 4. Translucent lens 4 is selectively attachable to flexible neck 3. Support housing 1, flesh auger 2, flexible neck 3, and translucent lens 4, form the casing for the positive solar wiring 12, negative solar wiring 8, positive LED wiring 14, and negative LED wiring 10. In various embodiments, cucurbit illuminating device may have a switch or remote-controlled component.

While the invention has been described with reference to the aforementioned specification, variations and substitutions will occur to those skilled in the art without departing from the scope of the invention. Various alternatives to the embodiments of the invention described herein may be employed in practicing the invention. It is therefore contemplated that the invention shall also cover any such alternatives, modifications, variations or equivalents. It is intended that the following claims define the scope of the invention and that methods and structures within the scope of these claims and their equivalents be covered thereby.

The apparatus described herein is not limited to a power source of a rechargeable battery power and or a standard battery power. Other power sources may be used with this apparatus. Placement of the power source is not limited to the area shown in the original drawings. The power source may be placed anywhere inside the structure housing and or the flesh auger. The power source may also be placed outside the housing structure.

The apparatus described herein is not limited to the type of materials for construction of the apparatus. The apparatus is not limited to the size and shape portrayed in the figures and drawings. The apparatus may be made from plastics, metals and of other composite materials. Other materials may be used to help illuminate the inside of structure to help direct the projection of the illumination. Aluminum foil, metal, silver foil, plastic foil and other reflective materials.

The apparatus described herein is not limited to the use of cucurbits; this apparatus may be used with other objects or other manmade materials that may be illuminated. The apparatus is not limited to a single illuminating source and or use. Multiple light sources, lenses and multi-colored lenses may be used. Light sources are not limited to an LED illuminator as the primary source of illumination. This apparatus may use other light sources as illumination.

The apparatus described herein is not limited to the style of flesh auger portrayed in the figures and drawings. Other styles of connecting devices may be used to attach to the object being illuminated. The apparatus is not limited to the flexible neck. Other styles of necks may be or may not be used. The apparatus is not limited to the finger indentations as described and depicted; other styles griping may be used or may not be used without departing from the scope of the invention.

What is claimed:

1. A weatherproof solar illuminator for use with a carved cucurbit, the weatherproof solar illuminator comprising:

an external housing with an integral cucurbit flesh auger, the flesh auger being configured to secure the weatherproof solar illuminator to the carved cucurbit by augering the flesh auger into a surface of the carved cucurbit;

a power source disposed within the external housing;

a solar-activated charging panel coupled to the external housing and to the power source; and a light emitting diode (LED) with a clear lens disposed at an end of the flesh auger and configured to illuminate the carved cucurbit, the LED being electrically connected to the power source.

2. The weatherproof solar illuminator of claim 1 further comprising a plurality of pimpled finger indents positioned around the external housing for gripping the weatherproof solar illuminator housing while installing and augering the flesh auger securely to the surface of the carved cucurbit.

3. The weatherproof solar illuminator of claim 1 wherein the power source is a rechargeable battery.

4. The weatherproof solar illuminator of claim 1 further comprising a flexible neck attached to the end of the flesh auger, wherein the LED is connected to the flexible neck by a threaded connection.

5. The weatherproof solar illuminator of claim 1 wherein the housing has a lower concaved/curved surface plate configured to be held flush against the surface of the carved cucurbit by the flesh auger.

6. A method for using the weatherproof solar illuminator of claim 1 to illuminate a carved cucurbit, the method comprising:

opening a hole in the surface of the carved cucurbit;

screwing the weatherproof solar illuminator into the surface of the cucurbit through the hole using the flesh auger until a lower surface of the housing is flush against the surface of the carved cucurbit, such that the flesh auger secures the weatherproof solar illuminator to the surface of the cucurbit and the LED protrudes into an interior cavity of the carved cucurbit; and illuminating the LED using electrical energy supplied from the power source.

7. A weatherproof solar illuminator for use with a carved cucurbit comprising:

a housing having a lower concaved/curved surface plate configured to rest flush against an outer surface of the carved cucurbit;

a flesh auger integral with the housing and extending outwardly from the lower concaved/curved surface plate, said flesh auger being configured for insertion down-through a hole in said outer surface of said carved cucurbit to protrude into an interior cavity of said carved cucurbit;

a light emitting diode (LED) secured to an end of said flesh auger, said flesh auger and LED being positioned perpendicular to the outer surface of the cucurbit;

a power source component disposed within said housing and being electrically coupled to the LED; and a solar-activated charging panel disposed on an upper surface of the housing and electrically coupled to the power source component and configured to receive solar energy;

wherein said flesh auger is configured to be screwed down into and through the outer surface of the carved cucurbit so as to secure said weatherproof solar illuminator to the outer surface of the carved cucurbit and such that the lower concaved/curved surface plate of the housing is flush against the outer surface of the carved cucurbit.

8. The apparatus weatherproof solar illuminator of claim 7 further comprising: a clear lens positioned at the end of the flesh auger over the LED.

9. The weatherproof solar illuminator of claim 7 further comprising a plurality of pimpled finger indents positioned around the housing for gripping the weatherproof solar illuminator housing while installing and augering the flesh auger securely to the outer surface of the carved cucurbit.

10. The weatherproof solar illuminator of claim 7 wherein the power source component includes at least one rechargeable power source configured to be recharged by the solar energy received by the solar-activated charging panel.

11. The weatherproof solar illuminator of claim 10 wherein the at least one rechargeable power source is a rechargeable dry-cell battery.

12. The apparatus weatherproof solar illuminator of claim 7 further comprising: one of a weatherproof gasket and a pre-molded gasket integral with the housing.

13. The weatherproof solar illuminator of claim 7 further comprising a flexible neck attached to the end of the flesh auger, wherein the LED is connected to the flexible neck by a threaded connection.

14. A method for using the weatherproof solar illuminator of claim 7 to illuminate the carved cucurbit, the method comprising:

opening the hole in the outer surface of the carved cucurbit;

inserting the flesh auger into the hole;

screwing the flesh auger into and through the exterior surface of the carved cucurbit, through the hole, until the lower concaved/curved surface plate of the housing is flush against the exterior surface of the carved cucurbit, such that the flesh auger secures the weatherproof solar illuminator to the outer surface of the cucurbit and the LED protrudes into the interior cavity of the carved cucurbit; and illuminating the LED using electrical energy supplied from the power source.

* * * * *